US008220492B2

(12) United States Patent
Lin

(10) Patent No.: US 8,220,492 B2
(45) Date of Patent: Jul. 17, 2012

(54) FAUCET DEVICE

(76) Inventor: Ming-Shuan Lin, Taichung Hsien (TW)

( * ) Notice: Subject to any disclaimer, the term of this patent is extended or adjusted under 35 U.S.C. 154(b) by 501 days.

(21) Appl. No.: 12/559,741

(22) Filed: Sep. 15, 2009

(65) Prior Publication Data

US 2011/0061747 A1 Mar. 17, 2011

(51) Int. Cl.
*F16K 11/02* (2006.01)

(52) U.S. Cl. ..... 137/801; 137/315.12; 4/695

(58) Field of Classification Search ..... 137/315.12, 137/315.11, 625.4, 625.17, 801; 4/677, 695
See application file for complete search history.

(56) References Cited

U.S. PATENT DOCUMENTS 4,979,538 A * 12/1990 Krippendorf et al. ..... 137/359
5,224,509 A * 7/1993 Tanaka et al. ..... 137/315.03
6,006,784 A * 12/1999 Tsutsui et al. ..... 137/801
6,394,132 B1 * 5/2002 Walcome ..... 137/614.2
6,807,692 B2 * 10/2004 Tsutsui et al. ..... 4/695
7,032,260 B2 * 4/2006 Hwang ..... 4/695
7,735,519 B2 * 6/2010 Lin ..... 137/801
7,828,013 B2 * 11/2010 Lin ..... 137/801
8,051,507 B2 * 11/2011 Lin ..... 4/677

* cited by examiner

*Primary Examiner* — Kevin Lee
(74) *Attorney, Agent, or Firm* — Ladas & Parry, LLP

(57) ABSTRACT

A faucet device includes a fixing unit having a water supply hole and a locking groove, a valve unit coupled separably to the fixing unit, a positioning unit, and a locking unit. The valve unit is movable between a first position to be connected to the fixing unit, and a second position to be separated from the fixing unit. The valve unit is rotatable relative to the fixing unit so as to be secured to the fixing unit by the positioning unit and to unblock the water supply hole, and is further rotatable reversely so as to be separable from the fixing unit and to block the water supply hole. The locking unit includes a locking component that is biased resiliently to engage the locking groove, and that is moved by the valve unit to be disengaged from the locking groove during movement of the valve unit from the second position to the first position.

3 Claims, 9 Drawing Sheets

FAUCET DEVICE

BACKGROUND OF THE INVENTION

1. Field of the Invention

The invention relates to a water outlet device, more particularly to a faucet device.

2. Description of the Related Art

U.S. patent application Publication No. 2008/0289698 A1 discloses a conventional faucet device comprising a fixing unit that is formed with a water supply hole, a connecting unit that is secured to a valve body and that is coupled separably to the fixing unit, and a switch unit that is retained rotatably on the fixing unit, that is coupled co-rotatably and separably to the connecting unit, and that is formed with a guide channel. The valve body is operable together with the connecting unit to rotate relative to the fixing unit between a first position so as to permit separation of the connecting unit from the fixing unit in a vertical direction, and a second position so as to prevent the separation of the connecting unit from the fixing unit in the vertical direction. When the valve body is at the first position and the connecting unit is separated from the fixing unit, e.g., during the replacement of the valve body, the switch unit is rotated to a stop position where the guide channel in the switch unit is misaligned with the water supply hole, and the switch unit blocks the water supply hole.

However, during the replacement of the valve body, since the switch unit is not locked at the stop position, it may be accidentally rotated to another position where the guide channel is aligned with the water supply hole, so that water may spout out from the guide channel.

SUMMARY OF THE INVENTION

Therefore, the object of the present invention is to provide a faucet device that has a simple structure and that is able to effectively prevent water from spouting out during maintenance and repair.

Accordingly, a faucet device of the present invention comprises a fixing unit, a valve unit, a positioning unit, and a locking unit. The fixing unit includes a fixing seat and a switch seat. The fixing seat is adapted to be mounted on a top surface of a deck, and has a water supply hole. The switch seat is coupled rotatably to the fixing seat, is positioned relative to the fixing seat along an axis normal to the top surface of the deck, and has a locking groove and a water inlet pipe that extends from the switch seat and that defines a guide channel therein. The valve unit includes a hollow valve body and a valve seat. The valve body has a top portion formed with a water outlet, and a bottom portion formed with an internal surrounding surface. The valve seat is disposed in the valve body, and has a coupling portion coupled separably to the water inlet pipe of the switch seat of the fixing unit, and a water inlet hole in fluid communication with the guide channel and the water outlet. The valve unit is movable along the axis between a first position, where the valve unit is connected to the fixing seat of the fixing unit, and a second position, where the valve unit is separated from the fixing seat. The positioning unit is disposed for coupling separably the valve unit to the fixing unit, and includes first and second positioning members provided respectively on the fixing unit and the valve unit. The valve unit is rotatable relative to the fixing unit from the first position in a first rotational direction so as to engage the second positioning member to the first positioning member, and to rotate the switch seat such that the guide channel in the water inlet pipe is aligned with the water supply hole in the fixing seat. The valve unit is further rotatable relative to the fixing unit back to the first position in a second rotational direction opposite to the first rotational direction so as to permit disengagement of the second positioning member from the first positioning member and movement of the valve unit from the first position to the second position, and to further rotate the switch seat such that the guide channel is misaligned with the water supply hole. The locking unit includes a locking component and a resilient component. The locking component is mounted pivotally to the fixing seat of the fixing unit, and has a locking end portion and a driven end portion that is opposite to the locking end portion. The locking component is pivotable between a locking state, where the locking end portion engages the locking groove in the switch seat for locking the switch seat to the fixing seat, and a releasing state, where the locking end portion is disengaged from the locking groove, thereby permitting rotation of the switch seat relative to the fixing seat. The resilient component is disposed for biasing the locking component to pivot to the locking state. The driven end portion of the locking component is pushed by the internal surrounding surface of the valve body of the valve unit to move the locking component from the locking state to the releasing state during movement of the valve unit from the second position to the first position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
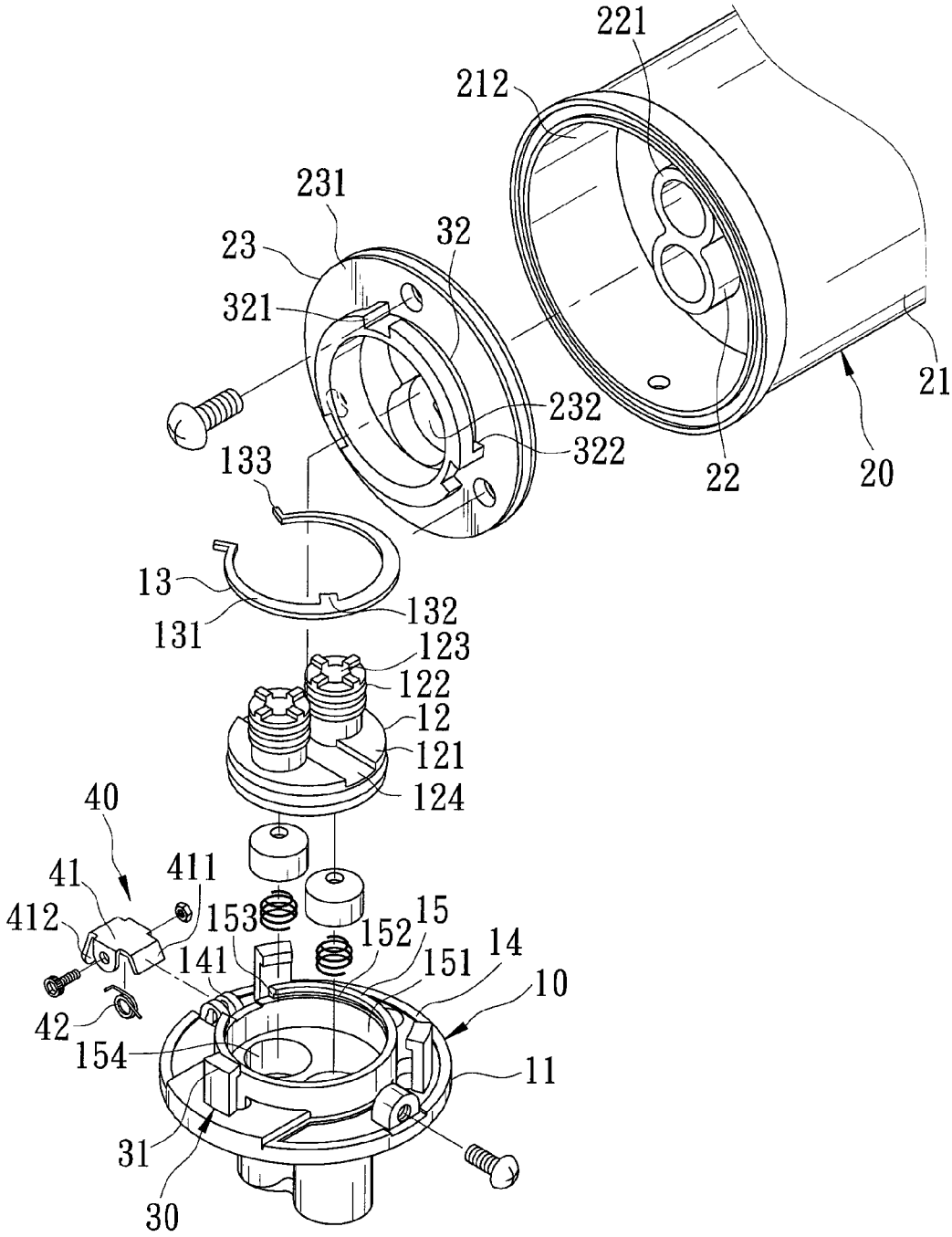
FIG. 1 is a fragmentary exploded perspective view of a preferred embodiment of a faucet device according to the invention.
Figure 2:
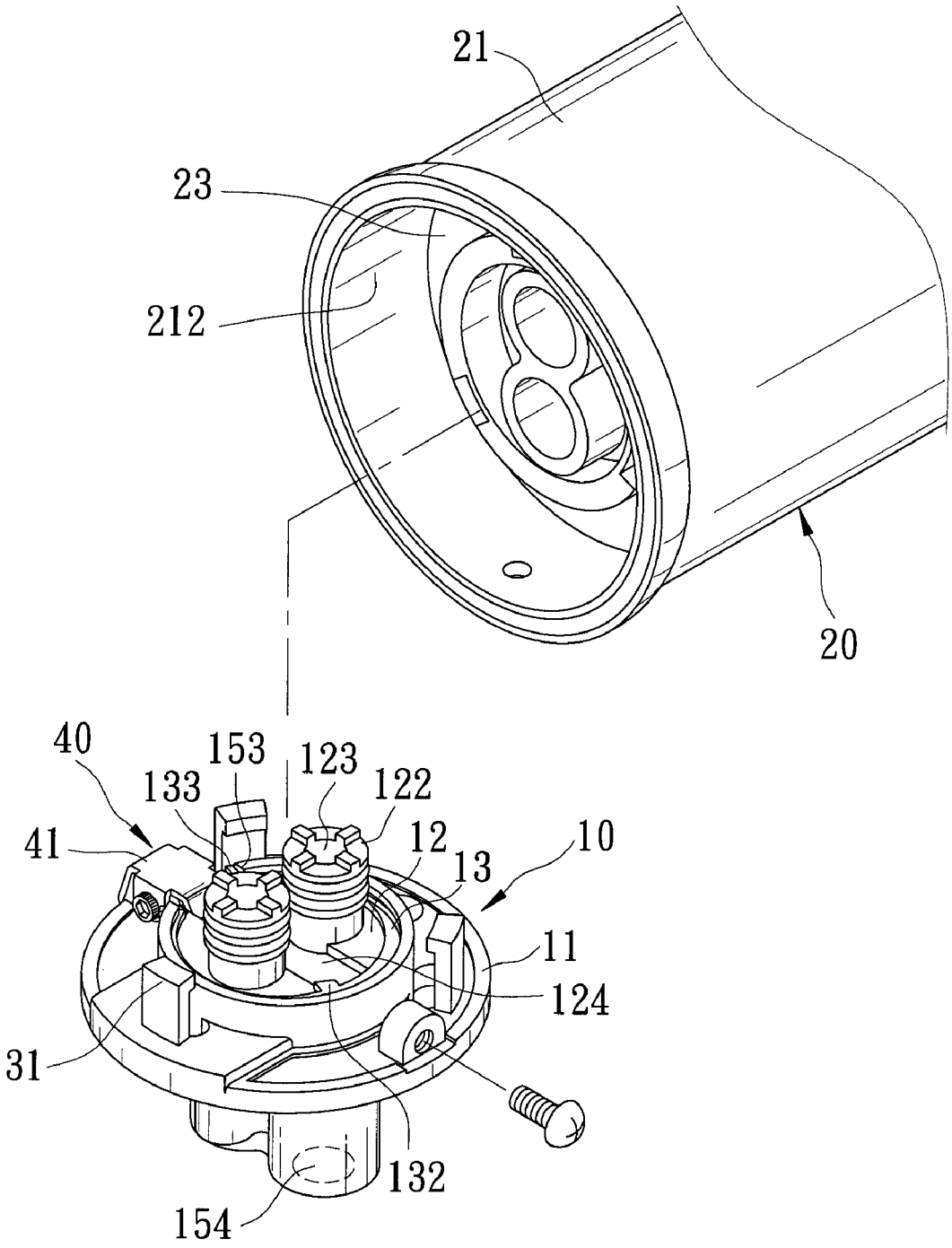
FIG. 2 is a fragmentary, partly exploded perspective view of the preferred embodiment.
Figure 3:
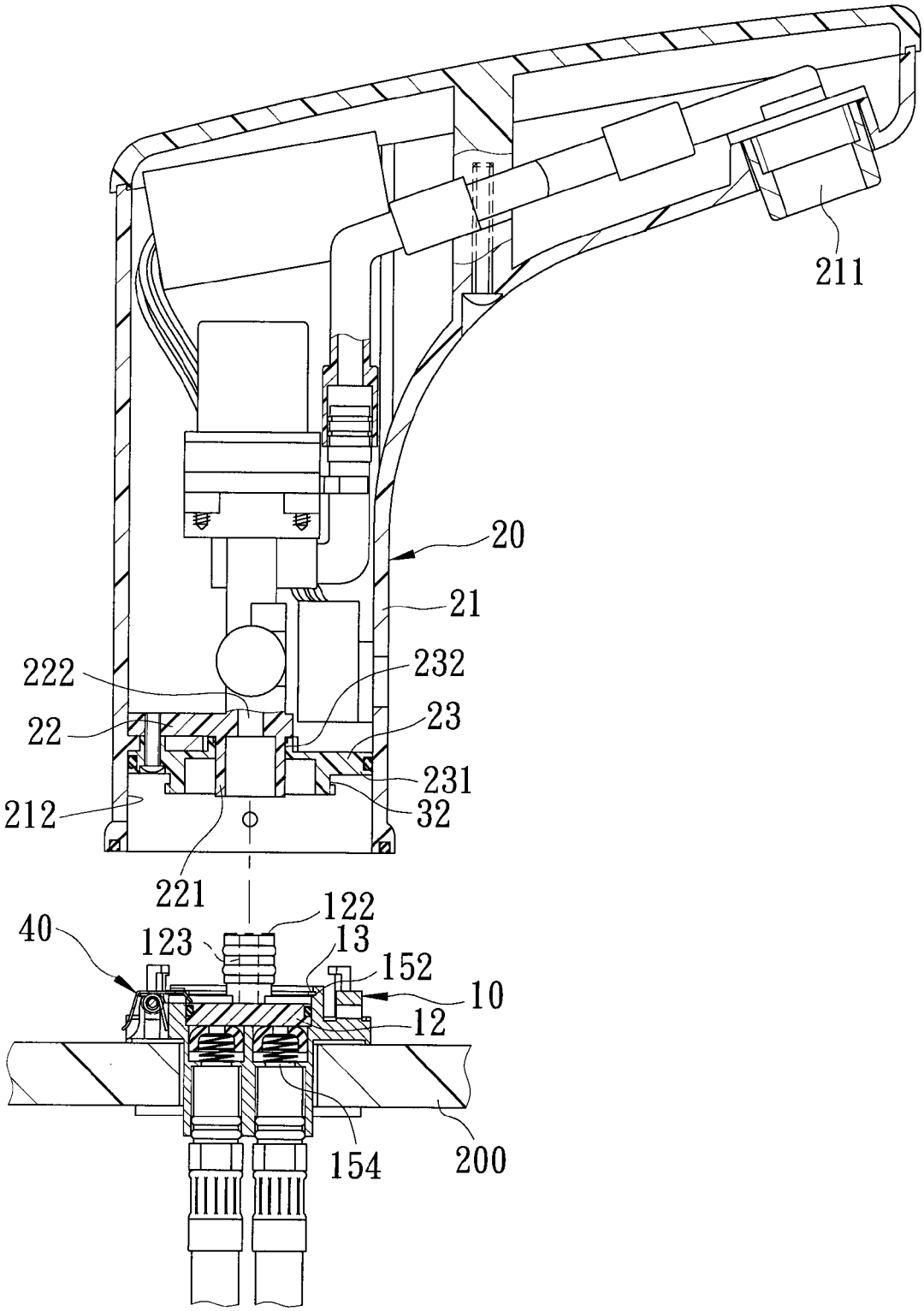
FIG. 3 is a partly exploded sectional view of the preferred embodiment.

As shown in FIGS. 1 to 3, the preferred embodiment of a faucet device according to the present invention comprises a fixing unit 10, a valve unit 20, a positioning unit 30, and a locking unit 40.

The fixing unit 10 includes a fixing seat 11 adapted to be mounted on a top surface of a deck 200, a switch seat 12 coupled rotatably to the fixing seat 11, and a C-ring 13 for positioning the switch seat 12 relative to the fixing seat 11 along an axis (L) that is normal to the top surface of the deck 200.

The fixing seat 11 has a fixing plate 14 and a surrounding wall 15 extending from the fixing plate 14 and surrounding the axis (L). The fixing plate 14 has a pivoting portion 141 mounted thereon between the surrounding wall 15 and a periphery of the fixing plate 14. In this embodiment, the fixing seat 11 further has a pair of water supply holes 154, and a receiving hole 151 formed with a bottom hole end that communicates fluidly with the water supply holes 154, and a top hole end that is opposite to the bottom hole end along the axis (L) and that is defined by the surrounding wall 15. The fixing seat 11 further has an annular groove 152 that is formed in an inner surface of the surrounding wall 15, and a notch 153 that is formed at the surrounding wall 15 and that is in spatial communication with the annular groove 152.

In this embodiment, the switch seat 12 has a seat body 121 received rotatably in the receiving hole 151, a pair of spaced-apart water inlet pipes 122 extending from the seat body 121, and a locking groove 124 formed in the seat body 121 between the water inlet pipes 122. Each of the water inlet pipes 122 defines a guide channel 123 therein.

The C-ring 13 has a C-shaped ring body 131 inserted in the annular groove 152, a pair of engaging parts 133 projecting radially, outwardly and respectively from opposite ends of the ring body 131 for engaging the fixing seat 11 at the notch 153, and a limit block 132 protruding radially and inwardly from the ring body 131.

The valve unit 20 includes a hollow valve body 21 and a valve seat 22 disposed in the valve body 21. The valve body 21 has a top portion formed with a water outlet 211, and a bottom portion formed with an internal surrounding surface 212. In this embodiment, the valve seat 22 has a pair of coupling portions 221 coupled separably and respectively to the water inlet pipes 122, and a pair of water inlet holes 222 formed respectively in the coupling portions 221 and in fluid communication with the guide channels 123 and the water outlet 211. The valve unit 20 further includes a linking component 23 having a top plate 231 which is mounted securely in the bottom portion of the valve body 21, and a pair of through holes 232 through which the coupling portions 221 of the valve seat 22 respectively extend. The valve unit 20 is movable along the axis (L) between a first position (see FIG. 5), where the valve unit 20 is connected to the fixing seat 11, and a second position (see FIG. 3), where the valve unit 20 is separated from the fixing seat 11.

The positioning unit 30 is disposed for coupling separably the valve unit 20 to the fixing unit 10. In this embodiment, the positioning unit 30 includes a plurality of angularly spaced-apart first positioning members 31 and a plurality of angularly spaced-apart second positioning members 32 provided respectively on the fixing unit 10 and the valve unit 20. In this embodiment, the first positioning members 31 are provided on the fixing seat 11 and surround the surrounding wall 15. Each of the first positioning members 31 is configured as an inverted L-shaped hook. Each of the second positioning members 32 is configured as an inverted L-shaped groove formed in the top plate 231 of the linking component 23, and has an open end 321 and an abutment end 322 opposite to the open end 321.

Figure 4:
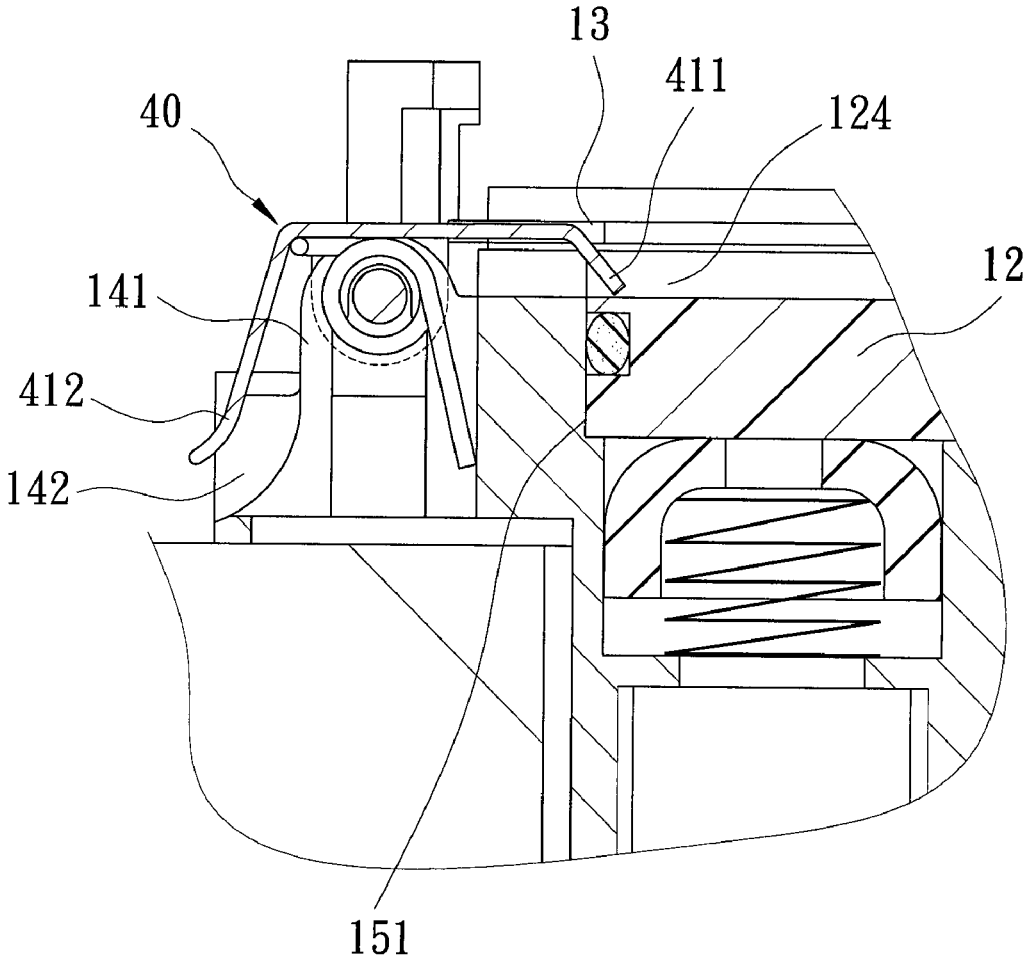
FIG. 4 is an enlarged fragmentary sectional view of the preferred embodiment, illustrating a locking component at a locking state.

The locking unit 40 includes a locking component 41 and a resilient component 42. The locking component 41 is mounted pivotally to the pivoting portion 141 of the fixing seat 11, and has a locking end portion 411 and a driven end portion 412 that is opposite to the locking end portion 411 and that extends through a notch 142 formed in a periphery of the fixing plate 14 (see FIG. 4). The locking component 41 is pivotable between a locking state (see FIGS. 3 and 4), where the locking end portion 411 engages the locking groove 124 in the switch seat 12 for locking the switch seat 12 to the fixing seat 11, and a releasing state (see FIGS. 5 and 6), where the locking end portion 411 is disengaged from the locking groove 124. The resilient component 42 is a torsion spring in this embodiment and is disposed for biasing the locking component 41 to pivot to the locking state.

Figure 5:
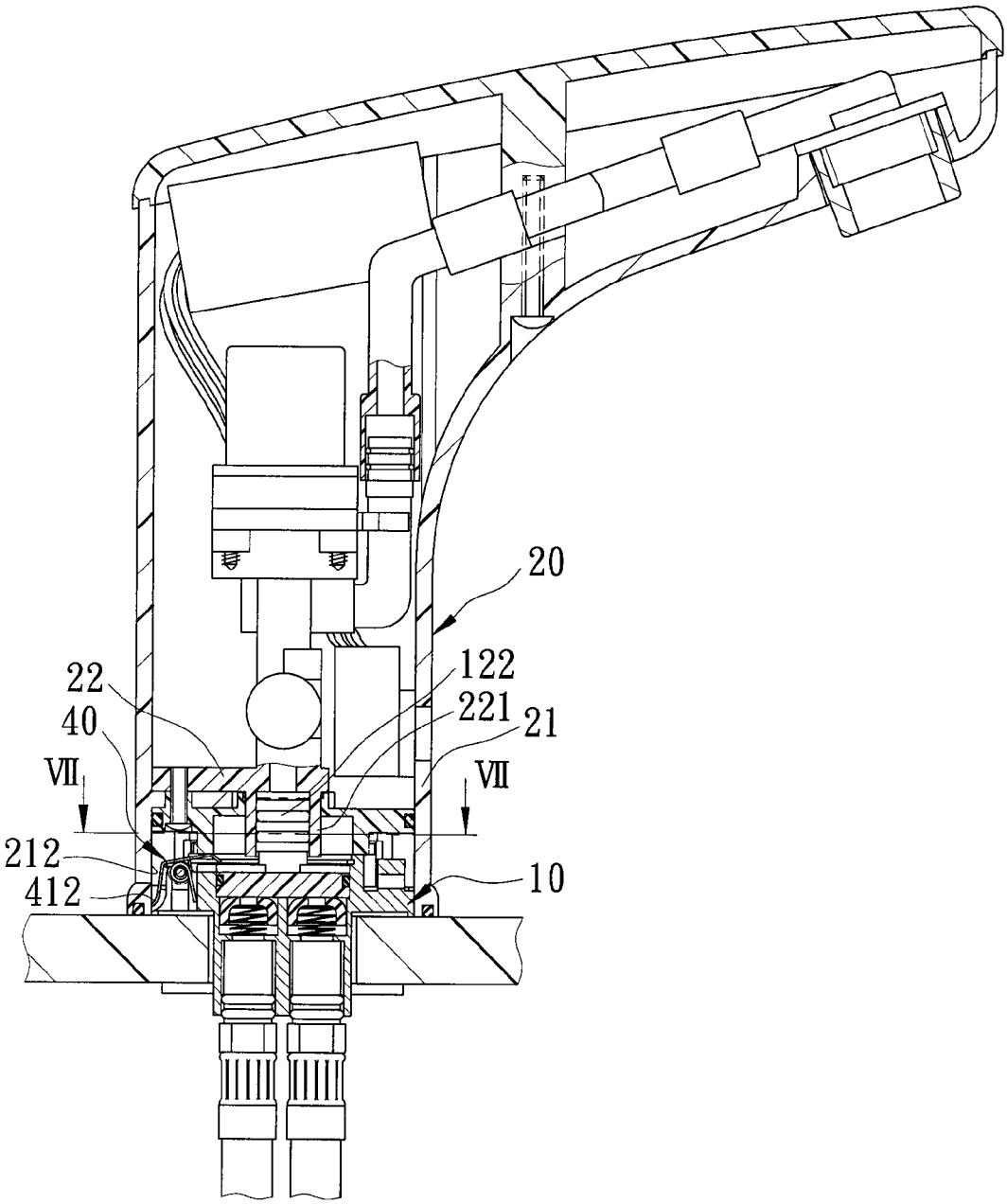
FIG. 5 is a partly sectional view of the preferred embodiment.
Figure 6:
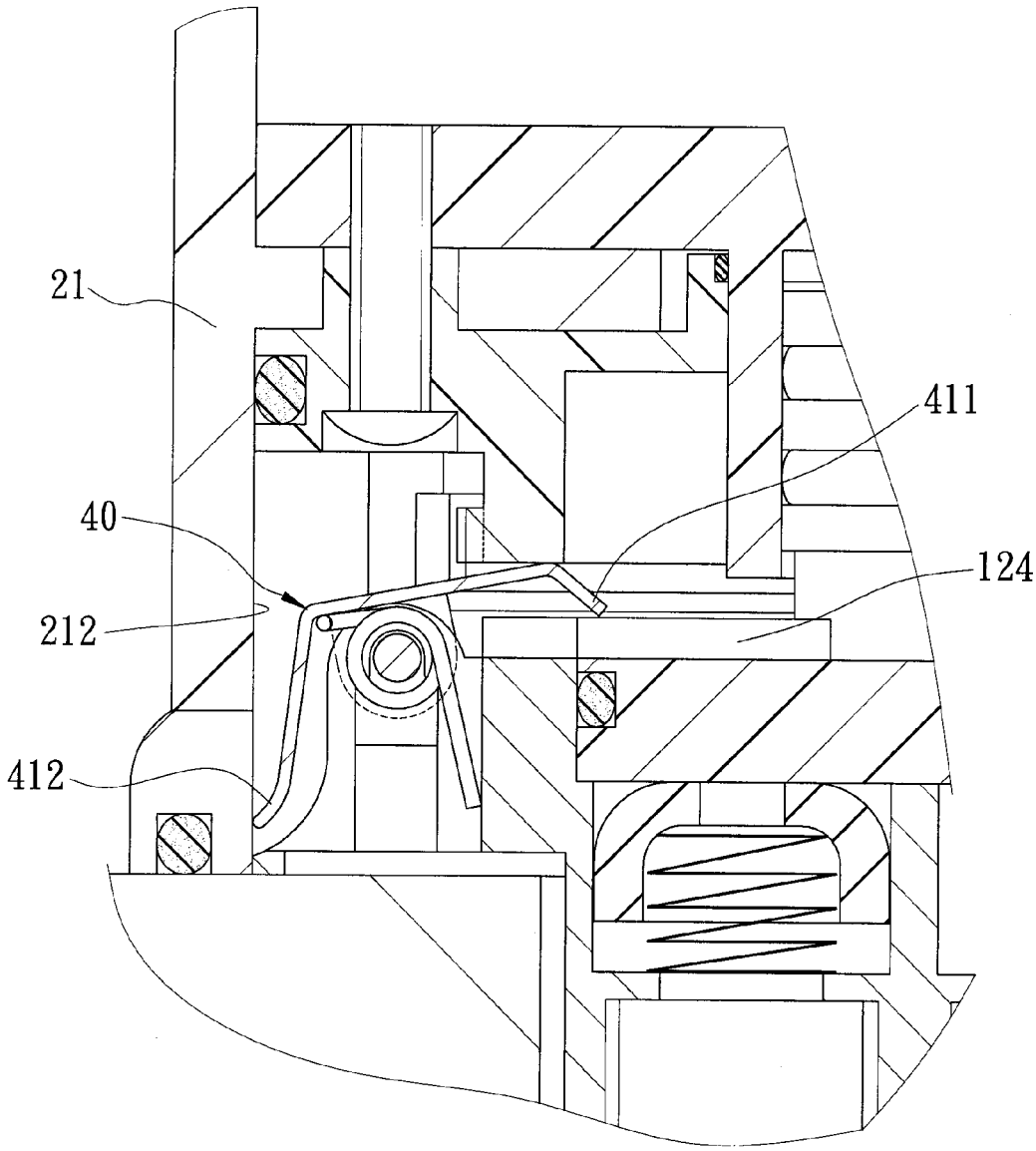
FIG. 6 is another enlarged fragmentary sectional view of the preferred embodiment, illustrating the locking at a releasing state.
Figure 7:
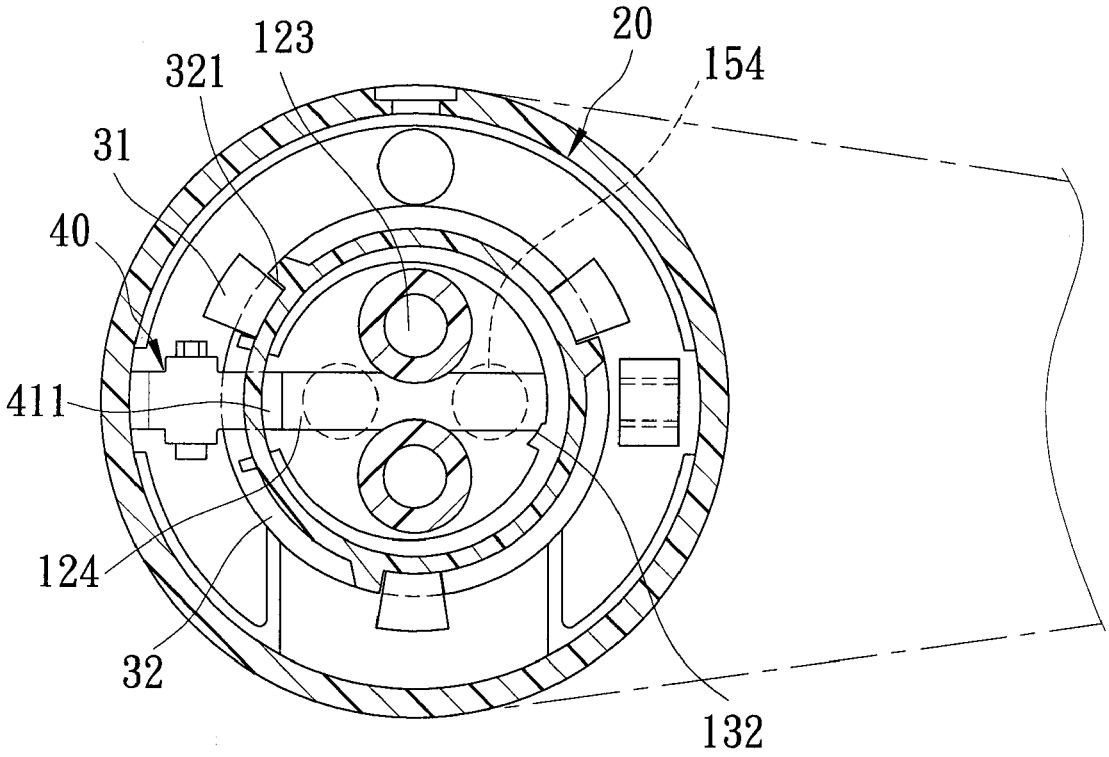
FIG. 7 is another sectional view of the preferred embodiment taken along line VII-VII in FIG. 5, illustrating a pair of guide channels that are misaligned with a pair of water supply holes.
Figure 8:
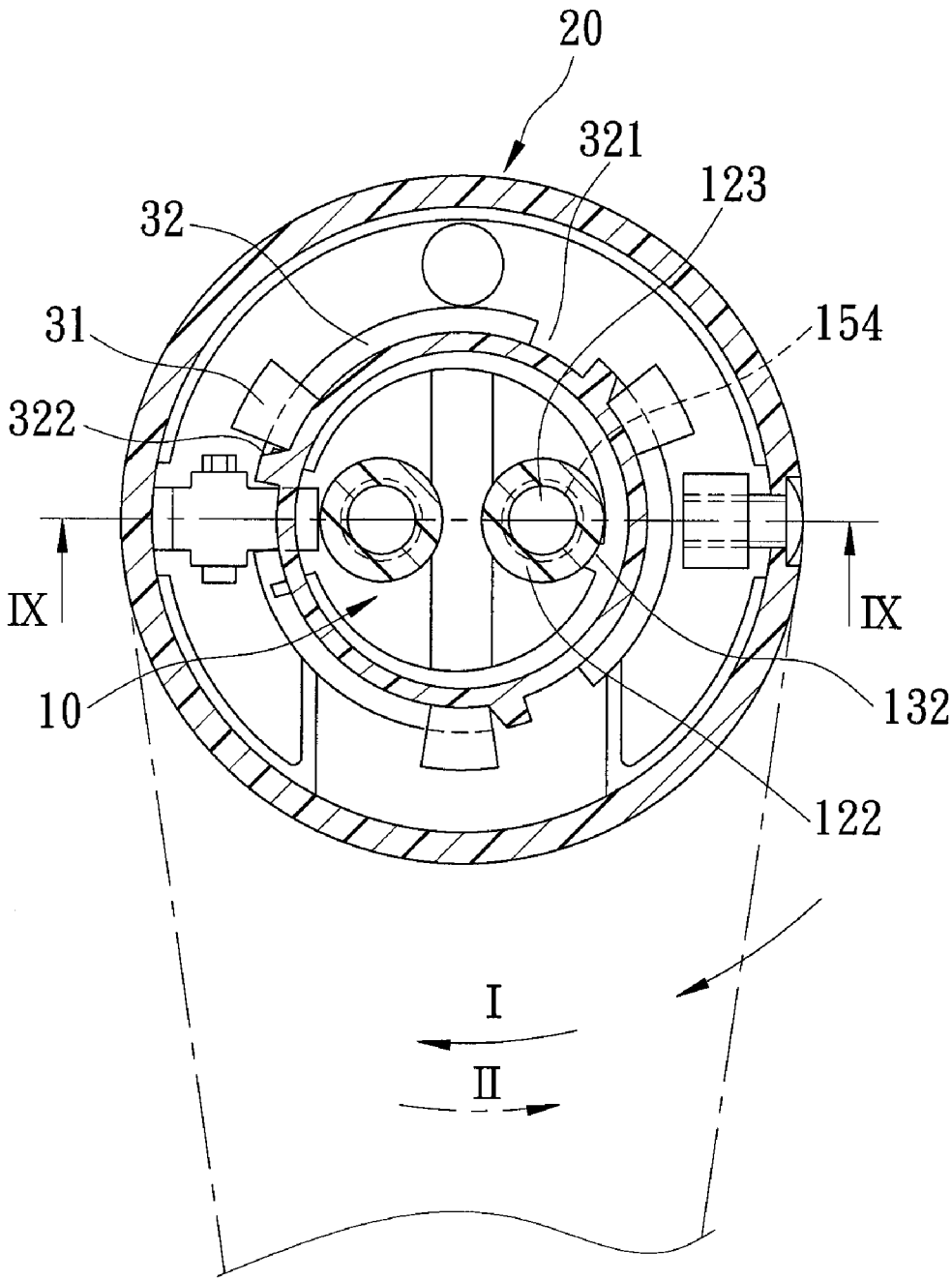
FIG. 8 is a view similar to FIG. 7, but illustrating the guide channels that are aligned respectively with the water supply holes.
Figure 9:
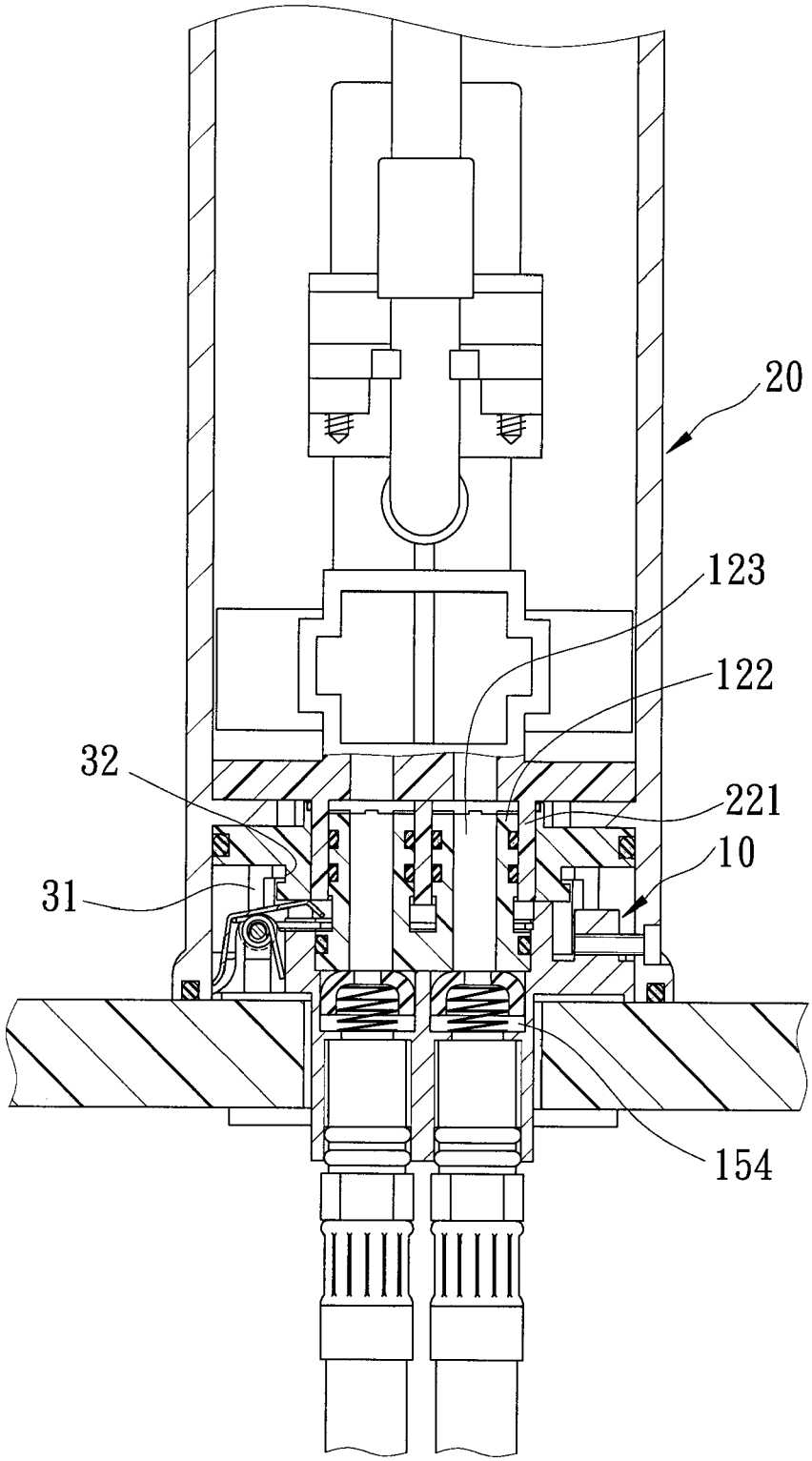
FIG. 9 is a fragmentary sectional view of the preferred embodiment taken along line IX-IX in FIG. 8.

As shown in FIGS. 5 to 7, when the valve unit 20 is operated to move relative to the fixing unit 10 from the second position to the first position, the driven end portion 412 of the locking component 41 is pushed by the internal surrounding surface 212 of the valve body 21 to move the locking component 41 from the locking state to the releasing state against a biasing force of the resilient component 42. Simultaneously, the coupling portions 221 of the valve seat 22 are sleeved fittingly and respectively on the water inlet pipes 122, and the first positioning members 31 extend respectively into the second positioning members 32, i.e., the inverted L-shaped grooves, at the open ends 321 of the second positioning members 32. At this time, the guide channels 123 in the water inlet pipes 122 are misaligned with the water supply holes 154 formed in the fixing seat 11 (i.e., the water supply holes 154 are blocked by the switch seat 12). Afterward, referring to FIGS. 8 and 9, the valve unit 20 can be rotated relative to the fixing unit 10 from the first position in a first rotational direction (I) so as to move the first positioning members 31 respectively along the second positioning members 32 toward the abutment ends 322 of the second positioning members 32 for engaging respectively the first positioning members 31 to the second positioning members 32, such that the valve unit 20 is coupled securely on the fixing unit 10. Since the coupling portions 221 of the valve seat 22 are sleeved respectively on the water inlet pipes 122, the rotation of the valve unit 20 in the first rotational direction (I) relative to the fixing unit 10 also rotates the switch seat 12 such that the guide channels 123 are aligned respectively with the water supply holes 154 in the fixing seat 11 (i.e., the water supply holes 154 are unblocked), and such that the limit block 132 of the C-ring 13 abuts against one of the water inlet pipes 122 to thereby limit rotation of the switch seat 12 relative to the fixing seat 10.

During replacement of the valve unit 20, the valve unit 20 can be rotated relative to the fixing unit 10 back to the first position in a second rotational direction (II) opposite to the first rotational direction (I) so as to rotate reversely the switch seat 12 such that the guide channels 123 are once again misaligned with the water supply holes 154, respectively. Simultaneously, the rotation of the valve unit 20 in the second rotational direction (II) also drives the first positioning members 31 to move reversely and respectively along the second positioning members 32 toward the open ends 321 of the second positioning members 32 so as to permit disengagement of the first positioning members 31 from the second positioning members 32. Afterward, the valve unit 20 can be easily moved from the first position to the second position to be separated from the fixing unit 10 so as to release the driven end portion 412 of the locking component 41, so that the locking component 41 is biased by the resilient component 42 to move back to the locking state, thereby positioning the switch seat 12 relative to the fixing seat 11. Since the switch seat 12 is positioned relative to the fixing seat 11 by virtue of the engagement between the locking end portion 411 of the locking component 41 and the locking groove 124 in the switch seat 12, accidental rotation of the switch seat 12 relative to the fixing seat 11 can be avoided during the replacement of the valve unit 20.

It should be noted that the valve unit 20 may be configured to be mounted with an infrared sensing mechanism to serve as an automatic faucet, or be mounted with a traditional tap mechanism to serve as a traditional faucet.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A faucet device comprising:

a fixing unit including a fixing seat that has a water supply hole, and a switch seat that is coupled rotatably to said fixing seat, that is positioned relative to said fixing seat along an axis, and that has a locking groove, and a water inlet pipe extending from said switch seat and defining a guide channel therein;

a valve unit including a hollow valve body that has a top portion formed with a water outlet, and a bottom portion formed with an internal surrounding surface, and a valve seat that is disposed in said valve body, and that has a coupling portion coupled separably to said water inlet pipe of said switch seat of said fixing unit, and a water inlet hole in fluid communication with said guide channel and said water outlet, said valve unit being movable along the axis between a first position, where said valve unit is connected to said fixing seat of said fixing unit, and a second position, where said valve unit is separated from said fixing seat;

a positioning unit disposed for coupling separably said valve unit to said fixing unit, and including first and second positioning members provided respectively on said fixing unit and said valve unit, said valve unit being rotatable relative to said fixing unit from the first position in a first rotational direction so as to engage said second positioning member to said first positioning member, and to rotate said switch seat such that said guide channel in said water inlet pipe is aligned with said water supply hole in said fixing seat, said valve unit being further rotatable relative to said fixing unit back to the first position in a second rotational direction opposite to the first rotational direction so as to permit disengagement of said second positioning member from said first positioning member and movement of said valve unit from the first position to the second position, and to further rotate said switch seat such that said guide channel is misaligned with said water supply hole; and a locking unit including a locking component mounted pivotally to said fixing seat of said fixing unit and having a locking end portion and a driven end portion that is opposite to said locking end portion, said locking component being pivotable between a locking state, where said locking end portion engages said locking groove in said switch seat for locking said switch seat to said fixing seat, and a releasing state, where said locking end portion is disengaged from said locking groove, thereby permitting rotation of said switch seat relative to said fixing seat, and a resilient component disposed for biasing said locking component to pivot to the locking state;

wherein said driven end portion of said locking component is pushed by said internal surrounding surface of said valve body of said valve unit to move said locking component from the locking state to the releasing state against a biasing force of said resilient component during movement of said valve unit from the second position to the first position.

2. The faucet device as claimed in claim 1, wherein:

said valve unit further includes a linking component having a top plate which is mounted securely in said bottom portion of said valve body, and a through hole through which said coupling portion of said valve seat extends;

said first positioning member of said positioning unit is provided on said fixing seat and is configured as an inverted L-shaped hook; and said second positioning member of said positioning unit is configured as an inverted L-shaped groove formed in said top plate of said linking component.

3. The faucet device as claimed in claim 2, wherein:

said fixing seat of said fixing unit further has a receiving hole that has a bottom hole end communicating fluidly with said water supply hole, and a top hole end opposite to said bottom hole end along the axis and defined by a surrounding wall, an annular groove that is formed in an inner surface of said surrounding wall, and a notch that is formed at said surrounding wall and that is in spatial communication with said annular groove; and said fixing unit further includes a C-ring that has a C-shaped ring body inserted in said annular groove, a pair of engaging parts projecting radially, outwardly and respectively from opposite ends of said ring body for engaging said fixing seat at said notch, and a limit block protruding radially and inwardly from said ring body for abutting against said water inlet pipe of said switch seat to limit rotation of said switch seat relative to said fixing seat when said guide channel in said water inlet pipe is aligned with said water supply hole.

* * * * *